US005368293A

United States Patent [19]

Waugh

[11] Patent Number: 5,368,293

[45] Date of Patent: Nov. 29, 1994

[54] PITCHER TRAINING APPARATUS

[76] Inventor: E. Leon Waugh, 1410 Tyler St., Eugene, Oreg. 97402

[21] Appl. No.: 925,099

[22] Filed: Aug. 6, 1992

[51] Int. Cl.[5] ..... A63B 69/40

[52] U.S. Cl. ..... 273/26 A; 273/374; 273/386; 273/394; 273/397; 273/402; 273/127 C; 340/815.83

[58] Field of Search ..... 273/26 A, 181 J, 181 K, 273/182 R, 181 A, 389, 390, 391, 398, 402, 406, 185 R, 348, 371, 374, 375, 376, 378, 382, 383, 386, 387, 390, 392, 376, 127 C; 340/815.24, 373

[56] References Cited

U.S. PATENT DOCUMENTS

| | | | |
|---|---|---|---|
| 1,640,954 | 8/1927 | Mach | 273/392 |
| 2,059,365 | 11/1936 | King | 273/26 |
| 2,254,986 | 9/1941 | Ziel | 273/26 |
| 2,598,008 | 5/1952 | McKenzie | 273/406 |
| 2,657,931 | 11/1953 | Burrell | 273/26 A |
| 2,793,038 | 5/1957 | Wallace | 273/406 |
| 2,873,969 | 2/1959 | Ziel | 273/26 |
| 2,890,052 | 6/1959 | Burrell | 273/26 A |
| 3,014,725 | 12/1961 | Lewis | 273/406 |
| 4,118,028 | 10/1978 | Larkin | 273/26 |
| 4,232,867 | 11/1980 | Tate | 273/406 |
| 4,254,952 | 3/1981 | Playter, Jr. | 273/26 |
| 4,275,883 | 6/1981 | Grimaldi | 273/26 |
| 4,461,475 | 7/1984 | Nakamura | 273/374 |
| 4,659,090 | 4/1987 | Kustanovich | 273/376 |
| 5,029,873 | 7/1991 | Davis | 273/376 |

*Primary Examiner*—Theatrice Brown
*Attorney, Agent, or Firm*—James D. Givnan, Jr.

[57] ABSTRACT

A housing is provided having multiple openings in its front wall each opened and closed by a closure positioned by a pneumatic cylinder. Each closure, when retracted from its opening, provides a target for the pitcher. A programmable controller in the housing permits the preselection and dwell time of the cylinders to be actuated and for the presentation of an array of targets in and out of a strike zone. A thrown ball impacting a retracted closure momentarily closes a switch to provide a signal to a counter. A ball return mechanism provides a partial vacuum in a ball receptacle at the pitcher's mound to retrieve balls from the interior of the housing. A remote control is provided to permit operation of the apparatus remote from the apparatus housing.

9 Claims, 1 Drawing Sheet

PITCHER TRAINING APPARATUS

BACKGROUND OF THE INVENTION

The present invention pertains generally to equipment used in the training of a baseball or softball pitcher to throw into different areas in and out of the strike zone.

In the training of pitchers it is necessary to develop control to the extent a pitcher may throw into several areas of a strike zone. In a game, the catcher will position his glove to provide a target for the pitch desired. In the training of some pitchers it is a problem to get the pitcher to visualize the strike zone above home plate. Undesirably some pitchers will visualize the strike zone in horizontal relationship to a batter which permits the batter to influence the undesired throwing of balls (as opposed to strikes) by the pitcher by either "crowding" home plate or standing away from same to cause the throwing of outside or inside pitches missing the strike zone. Accordingly it is important for a young pitcher to learn to pitch to a fixed strike zone without being influenced by the batter's position relative home plate.

In the prior art, U.S. Pat. Nos. 2,059,365; 2,254,986; 2,873,969; 4,118,028; 4,254,952 and 4,275,883 all show training equipment wherein a pitching target provides several target areas within a defined strike zone. Ball collecting and return means using gravity are shown in U.S. Pat. Nos. 2.059,365 and 4,275,883.

SUMMARY OF THE PRESENT INVENTION

The present invention is embodied in a pitcher training apparatus which provides a multitude of targets which may be activated in sequence.

The apparatus embodying the present invention includes a free standing housing having a front wall having several openings therein, each opened and closed by a closure positioned by electromechanical means. A programmable controller of the apparatus permits the preselection of certain closures to be opened in sequence with each constituting a target.

A practical embodiment of the present apparatus includes several target assemblies each having a closure member displaceable from its opening in the front wall of the housing to enable entry of the thrown ball into the housing and impact of same with the displaced closure. Air cylinders with piston rod ends have been found desirable for such mounting of the closures. Solenoid valves regulate the flow of pressurized air to the cylinders and are in circuit with the controller to enable preselection of which closures are to be targets and the duration of such actuation.

For tabulating accurately thrown pitches i.e., those pitches impacting a closure, tabulating means are provided including switch means associated with each closure. Balls impact against a closure to displace same, momentarily, to close a switch in circuit with a tabulator having a display or readout.

To facilitate relocation of the apparatus the same may be equipped with wheels and hand holds.

DETAILED DESCRIPTION OF THE PREFERRED EMBODIMENTS

Figures 1, 2, 3, 4:
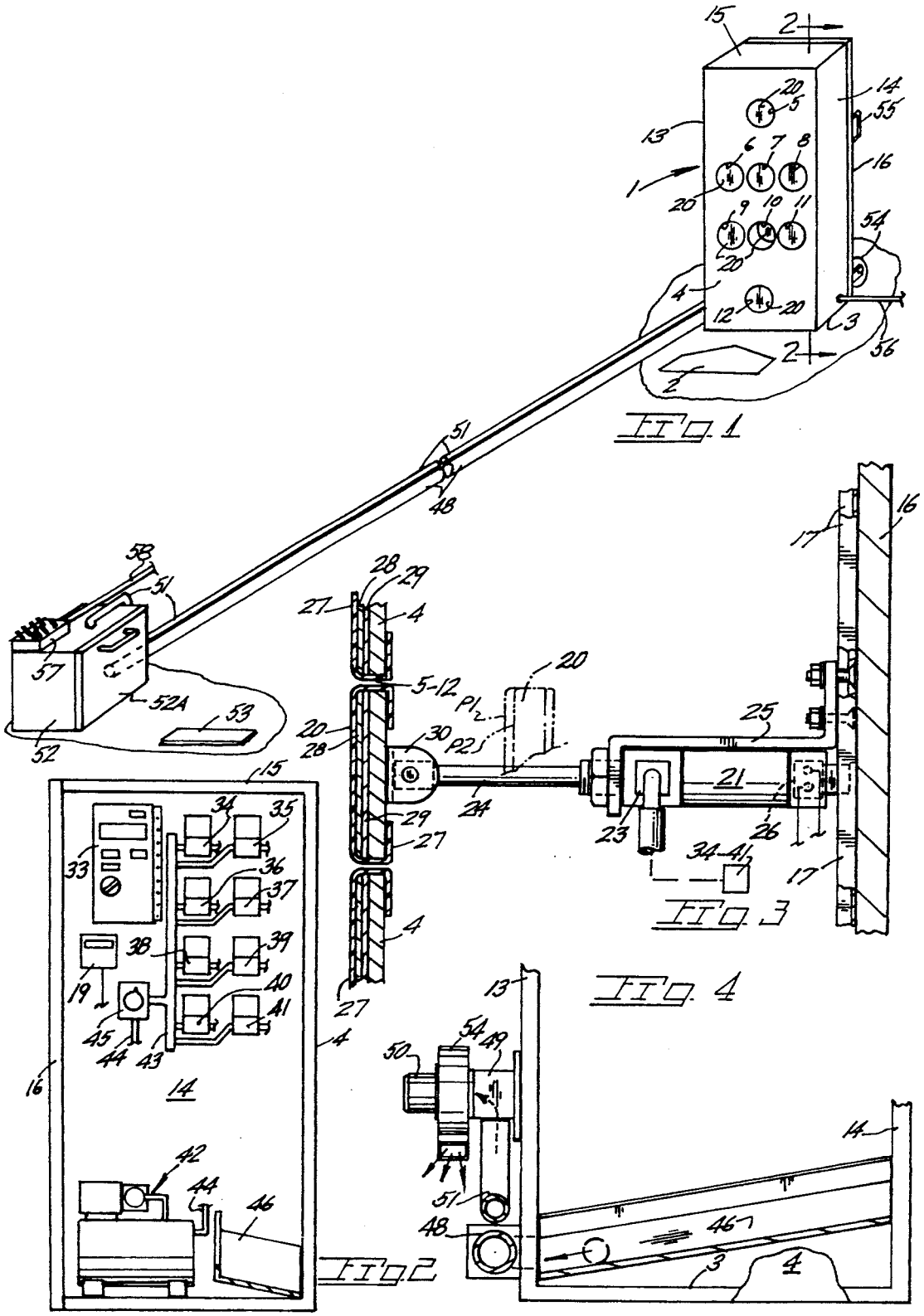
FIG. 1 is a perspective view of the present apparatus operatively disposed.
FIG. 2 is a vertical sectional view of the apparatus housing taken along line 2—2 of FIG. 1 and showing a side wall with electrical components thereon.
FIG. 3 is a side elevational view of a typical target assembly of the apparatus.
FIG. 4 is a vertical sectional view of the lower portion of the housing of the apparatus showing a sloped false floor.

With continuing attention to the drawings, the applied reference numeral 1 indicates generally the housing of the present apparatus adapted for placement on a ground surface provided with a home plate 2.

The housing is intended for upright placement on a bottom wall 3 with a front wall 4 defining openings as at 5–12. Side walls are at 13 and 14 while a top wall is at 15. A rear door at 16 is provided with a suitable latch, not shown.

In place on the interior of door 16 are vertically disposed, channels as at 17. The channels 17 serve to support target assemblies, as later described, each substantially in axial alignment with one of the front wall openings 5–12. Each target assembly includes a circular closure 20 for registration with one of said openings to close same. A pneumatic cylinder at 21 is part of an actuator assembly including a solenoid operated air valve later described. The cylinder is preferably of the single acting type having an outwardly spring biased piston rod 24 and a forward port receiving a valve regulated air flow through a fitting 23. A clevis 30 attaches closure 20 to the distal end of piston rod 24. A bracket 25 on a channel 17 carries the end mounted cylinder with the spring biased or extended piston rod 24 locating closure 20 forwardly in a opening 5–12. A switch at 26 is in cylinder 21 and is in circuit with a counter at 19 in FIG. 2 for tabulating the number of contacts a thrown ball makes with a closure 20. The piston rod and piston being spring biased, momentarily retracts somewhat, beyond air biased retraction, upon being impacted by a pitched ball to close switch 26. To reduce rebound of the ball, the closures 20 and housing front wall 4 are provided with a cover of vinyl sheet material 27 which overlies a layer of felt 28 which, in turn, overlies a segment of carpet pad 29.

A control system for each of the target assemblies includes controller 33 installed on side wall 14 of housing 1. Controller 33 is preferably of the programmable type such as that manufactured by Waterman, Modicon and Westinghouse to mention but a few sources. The controller has terminals in circuit with three way, solenoid operated air valves 34–41 to permit the selection of valve operation sequence and dwell time. The wiring is not shown for the sake of clarity. Each solenoid valve 34–41 is served with a source of pressurized air via a manifold 43. An air compressor unit generally 42 is installed in housing 1 with an outlet line 44 routed to manifold 43 via settable air pressure regulator 45. From the foregoing it will be evident that a pitching coach or other user may program controller 33 to retract, in sequence closures 20 from their respective openings 5–12, for desired periods to constitute targets for the pitcher.

Balls subsequent to impacting a closure 20 will fall toward the bottom of housing 1 and contact an inclined plate 46 tilted along two axes which causes the balls to roll toward an outlet in housing wall 13 and enter a delivery tube 48. A low pressure source for tube 48 is provided by a motor 50 and an impellor assembly in a wall mounted housing 54. A vacuum line 51 from a vacuum box 49 serves to effect a partial vacuum in a ball cabinet 52 adjacent a pitching mound 53. Accordingly balls entering ball return tube 48 are deposited in remotely disposed cabinet 52 for access by the pitcher, a coach or other user of the apparatus. A door 52A in the cabinet is spring biased closed and forms an air seal with the box edges when closed.

To facilitate movement of housing 1 the same may be provided with wheels at 54 and hand holds as at 55 to allow travel in the manner of a hand truck.

In operation, the housing 1 is placed into position preferably proximate a backstop and a power supply cord 56 plugged into a 110 v. source. The programmer 33 is set by the user to open and close the selected openings 5–12 by actuation of the solenoid valves 34–41 and their associated pneumatic cylinders 21. The present apparatus is particularly effective to train pitchers having trouble throwing pitches to certain parts of the strike zone as the pitching coach may set the programmer to open only certain closures 20 as desired. Counter 19 is resettable to provide a record of the number of balls passing through an opening (or openings) 5–12 and hitting a rearwardly positioned closure 20. In FIG. 3, closure positions P1 and P2 are shown with P1 representing the normal cylinder retracted or displaced position of the closure while P2 indicates the momentarily displaced position of the cover resulting from the impact of a ball to close switch 26. A suitable pneumatic cylinder with switch is manufactured and sold under the name Humphrey Air Cylinders. If desired, switch 26 could be external of the cylinder and actuated by the displaced closure.

A modified control means permits manual control of the target assemblies. A control box 57, remote from housing 1, is provided with single throw, single pole switches each in circuit with a power source and one of the electric solenoid operated valves 34–41 via a service cable 58 provide control circuits for each solenoid operated valve 34–41 preferably of the type having a reduced voltage requirement of 25 v. A.C.,.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

1. An apparatus for training a pitcher by providing multiple sequentially presented targets at which a ball is to be thrown, said apparatus comprising, a housing having a front wall defining openings through which a thrown ball may pass, target assemblies mounted interiorly of said housing adjacent each of said openings and each of said assemblies including a closure which normally closes one of said openings, each of said target assemblies further including a pneumatic cylinder, means of coupling said cylinder to said closure and enabling displacement of said closure to an open position away from one of said openings to open the latter, and control means including a programmable controller having a series of terminals, a solenoid operated valve in circuit with each of said terminals and in communication with the pneumatic cylinder of each of the target assemblies to activate said cylinder to displace the closure thereof to provide a target and to subsequently relocate the closure.

2. The apparatus as claimed in claim 1 wherein said controller includes a memory to enable automatic sequential operation of the target assemblies for opening of the housing openings for the presentation of different targets to a pitcher for selected periods of time.

3. The apparatus claimed in claim 1 additionally including a ball return system having a vacuum pump, a ball storage cabinet remote from said housing, air conduit means in communication with said vacuum pump and said ball storage cabinet, a ball return tube in communication with the interior of said housing and said cabinet, said housing including a sloped ball receiving surface and delivery means for routing a ball on said surface to said ball return tube for ball delivery to the ball storage cabinet.

4. The apparatus claimed in claim 1 wherein said pneumatic cylinder is of the spring biased type laving a piston and piston rod, said piston and piston rod spring biased in one direction to support said closure when retracted by said cylinder in a yieldable manner so as to permit the closure to move upon being contacted by a thrown ball, said pneumatic cylinder having switch means closeable upon the impact of a thrown ball against said closure.

5. The apparatus claimed in claim 5 wherein said switch means is internally disposed in said pneumatic cylinder, and a counter mechanism in circuit with said switch mechanism.

6. The apparatus claimed in claim 1 wherein said target assemblies each include switch means actuated by the impact of a ball against the closure of the target assembly when in a displaced open position, and a counter mechanism in circuit with said switch means.

7. In a pitcher training apparatus, a housing having a front wall with at least one opening therein for the passage of thrown balls into the housing, a target assembly in said housing including an actuator, a closure for said opening carried by the actuator and normally disposed in said opening, control means in said housing including a programmable controller having terminals, means in circuit with said terminals and in communication with said actuator whereby said controller may be programmed to actuate said actuator to open said opening and to close said opening in said housing to provide a target for the pitcher, a ball return system having a vacuum pump, a ball storage cabinet remote from said housing, air conduit means in communication with said vacuum pump and said ball storage cabinet, a ball return tube in communication with the interior of said housing and said cabinet, said housing including a sloped ball receiving surface and delivery means for routing a ball on said surface to said ball return tube for ball delivery to the ball storage cabinet.

8. The apparatus claimed in claim 7 wherein said actuator includes switch means closeable upon displacement of the closure by a pitched ball passing through said opening and impacting said closure.

9. The apparatus claimed in claim 9 additionally including a counter in circuit with said switch means to tabulate and display a total of the number of closings of said switch means by thrown balls.

* * * * *